US005898259A

United States Patent [19]

Reyal

[11] Patent Number: 5,898,259

[45] Date of Patent: Apr. 27, 1999

[54] SHADOW MASK FRAME OF A CATHODE RAY TUBE, ITS PROCESS OF MANUFACTURE, AND SUSPENSION ELEMENT OF A SHADOW MASK FRAME

[75] Inventor: Jean-Pierre Reyal, Eragny, France

[73] Assignee: Imphy S.A., Puteaux, France

[21] Appl. No.: 08/861,081

[22] Filed: May 21, 1997

[30] Foreign Application Priority Data

May 22, 1996 [FR] France ..... 96 06 366

[51] Int. Cl.[6] ..... H01J 29/07

[52] U.S. Cl. ..... 313/407; 313/402; 313/404

[58] Field of Search ..... 313/64, 92, 466, 313/470, 474, 402, 404, 405, 406, 407

[56] References Cited

U.S. PATENT DOCUMENTS

| | | | |
|---|---|---|---|
| 4,433,267 | 2/1984 | Kuryla et al. | 313/402 |
| 5,072,150 | 12/1991 | Lee | 313/405 |
| 5,103,132 | 4/1992 | Van Der Bolt et al. | 313/404 |
| 5,126,624 | 6/1992 | Ji | 313/402 |
| 5,210,459 | 5/1993 | Lee | 313/402 |
| 5,274,302 | 12/1993 | Capek et al. | 313/407 |
| 5,510,669 | 4/1996 | Van Buren | 313/402 |

FOREIGN PATENT DOCUMENTS 2 184 899 12/1973 France .

*Primary Examiner*—Ashok Patel
*Assistant Examiner*—Matthew J. Gerike
*Attorney, Agent, or Firm*—Oblon, Spivak, McClelland, Maier & Neustadt, P.C.

[57] ABSTRACT

The frame (30) comprises flat sides **(30*a*, 30*b*, 30*c*, 30*d*) disposed along the lateral faces of a right prismatic surface. The sides (30*a*, 30*b*, 30*c*, 30*d*) of the frame (30) comprise an outer panel (31) and an inner panel (32) which are assembled and fixed to each other and are each constituted by a portion of a thin metal strip preferably reinforced by ribs. Devices (34) for suspending the frame (30) in the glass case of the cathode ray tube may be fixed by clipping or by welding on corner portions (33) of the frame (30)**.

31 Claims, 10 Drawing Sheets

SHADOW MASK FRAME OF A CATHODE RAY TUBE, ITS PROCESS OF MANUFACTURE, AND SUSPENSION ELEMENT OF A SHADOW MASK FRAME

The invention relates to a shadow mask frame of a cathode ray tube and in particular a colour television tube.

Colour television tubes having a shadow mask comprise a glass case in which there are fixed metal parts of which one is formed by a shadow screen connected to a frame and another by a magnetic shielding disposed inside the glass case.

The glass case is composed of two parts, a slab comprising the screen on which the image is formed and a funnel on which the fixed the electron guns and the coils deflecting the electron beams of the cathode ray tube.

The shadow mask is manufactured from a thin metal strip in which openings of small size and adapted shape are formed by chemical machining. The metal strips employed are generally composed of low carbon steel or iron-nickel alloy such as Invar. The shadow mask is put into shape by a hot or cold press-forming so as to possess a peripheral flange along which a metal frame is welded.

The unit formed by the frame and the mask is fixed inside the glass slab by means of suspension devices fixed to the frame and engaging pins sealed in the glass of the slab.

The internal shielding of the tube can be fixed either to the frame of the shadow mask or to the fixing pins sealed in the glass of the slab.

Cathode ray tubes of different types are known which are distinguished in particular by the type of the shadow mask or the type of the frame used or by the manner of hooking the frame inside the glass case of the tube.

As concerns the different types of frames used, there exist in particular the thin and light frames whose thickness may be for example of the order of 0.2 mm and the thick, rigid and heavy frames.

As concerns the manner of hooking the frame inside the glass case, there exist the suspension of the frame in the vicinity of the corners of the screen and the suspension of the frame in the median part of the peripheral edges of the slab by means of bimetal compensating devices fixed to the outer surface of the sides of the frame.

The suspension of the shadow mask by means of its frame inside the glass case of the tube must permit performing several functions. First, this suspension must permit controlling the relative movements of the glass screen and the shadow mask, caused in particular by the expansion of the shadow mask which becomes heated under the impact of the electron beam, so as to maintain the purity of the colours of the image formed on the screen.

Further, the suspension devices must maintain the shadow mask in position inside glass case, even when the cathode ray tube receives a shock, and protect the shadow mask against external mechanical forces.

Lastly, the suspension systems must permit dismounting or shifting the shadow mask during the manufacture of the cathode ray tube, and then putting it back in position inside the glass case as many times as may be necessary.

The unit comprising the shadow mask, the frame and the suspension devices of the frame must have in particular the following properties:

- on one hand, it must permit accommodating the variations in dimension resulting from an overall heating of the assembly,
- on the other hand, it must have a great mechanical stability.

Most of the units known in the art use a rigid, heavy, thick steel frame hooked by means of three or four bimetal springs engaged on pins sealed in the median part of the peripheral edges of the glass slab. The drawbacks of these known units are that the frame has a high thermal inertia and the manner of compensating for variations of dimension of thermal origin is not completely symmetrical.

It is also known to employ rigid, heavy, thick steel frames which are hooked on the corners of the slab by means of four suspension systems. This arrangement is symmetrical and has the advantage of a thermal self-compensation; however, the frame still has an excessive thermal inertia.

Further, the thick frames of the prior art often have an excessive weight which may be for example of the order of, or heavier than, 2 kg., in the case of so-called "taut mask" technologies, the shadow mask being put under tension on the frame whose stiffness must be sufficient to resist stresses resulting from putting the mask under tension.

It is also known to employ thin frames whose thickness may be for example on the order of 200 $\mu$m, these light frames being hooked in the corners of the slab.

These light frames have the advantage of having a low thermal inertia but are very fragile owing to their thinness. These frames also have an insufficient stiffness. Consequently, it may be necessary to weld the suspension devices to the fixing pins to avoid the unhooking of the frame. The manufacture of the cathode ray tube is consequently rendered more complex.

An object of the invention is therefore to provide a shadow mask frame of a cathode ray tube and in particular of a colour television tube having flat sides disposed substantially along the lateral faces of a right prismatic surface and having a stiffening edge portion for fixing the shadow mask to the frame by means of which the shadow mask is placed in position inside a glass case of the cathode ray tube which comprises a funnel and a slab comprising a screen, said frame having a good mechanical stiffness, a weight as low as possible for a given stiffness, a low thermal inertia and other advantages, for example a limited sensitivity to periodic external forces, in a frequency range for example between 100 and 400 Hz.

For this purpose, the flat sides of this frame comprise an outer panel and an inner panel which are brought together and fixed one against the other and are each made from a portion of a thin metal strip.

Preferably, in order to increase the mechanical stiffness of the frame, at least one of the outer and inner panels is reinforced by at least one press-formed portion of the panel.

According to a preferred embodiment, one of the panels, or both panels, are reinforced by ribs.

In order to explain the invention, there will now be described, as non-limitative examples with reference to the accompanying drawings, several embodiments of a shadow mask frame according to the invention.

Figure 5:
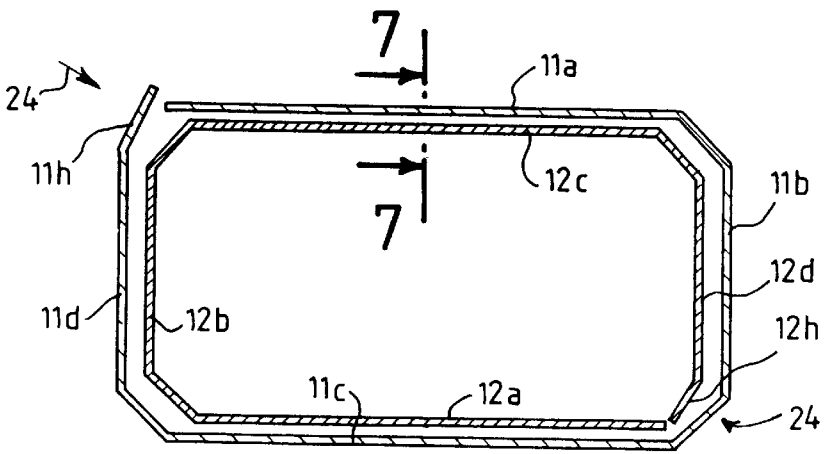
FIG. 5 is a top plan view of the metal strips shown in FIG. 4 in their assembled position before welding.
Figure 6:
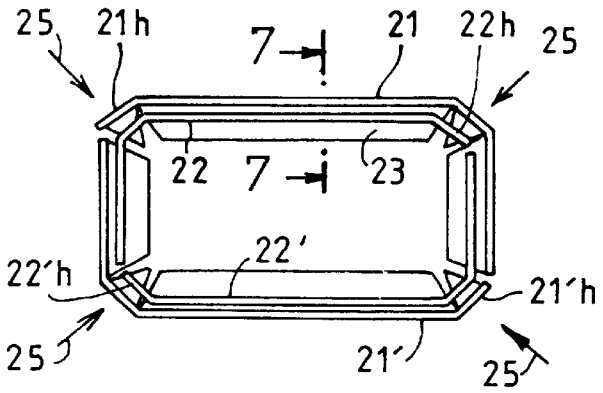
FIG. 6 is a top plan view similar to FIG. 5 showing the metal strips such as those shown in FIGS. 3A and 3B, in their assembled position before welding.

FIG. 7A, 7B, 7C, and 7D are vertical sectional views taken along line 7–7 of FIG. 5 or FIG. 6, showing an outer panel and an inner panel of the shadow mask frame according to the invention in their assembled position and a part of a mask in a position in which it is assembled with the frame.

Figure 8A:
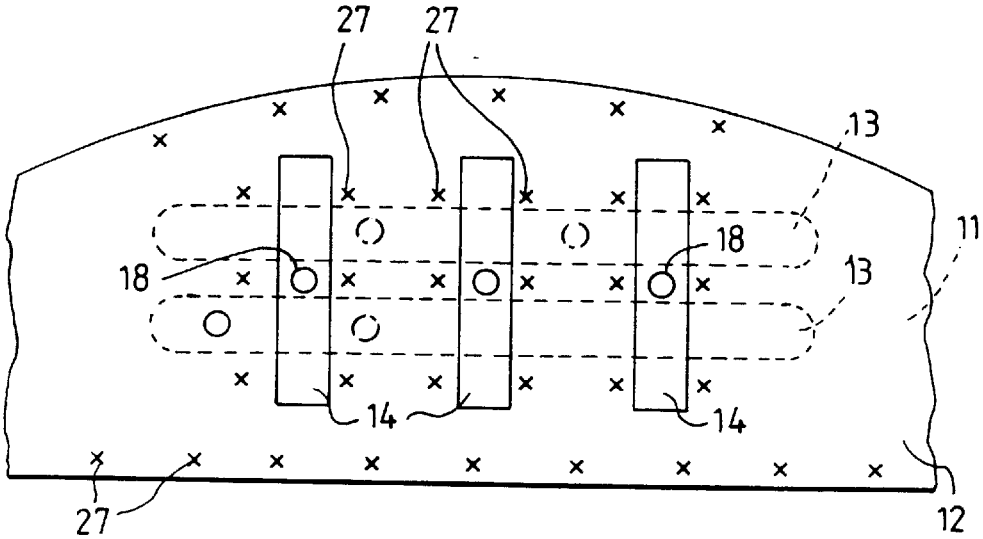
Figure 8B:
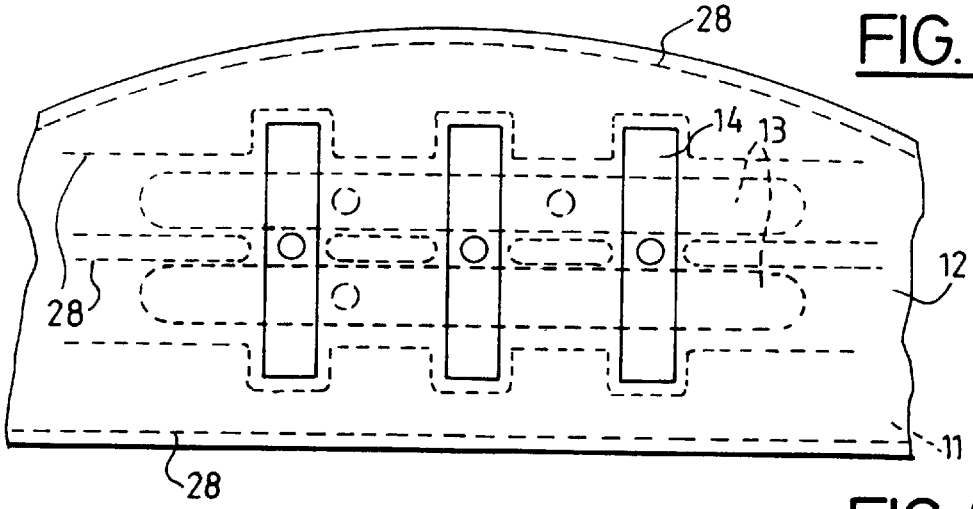
Figure 8C:
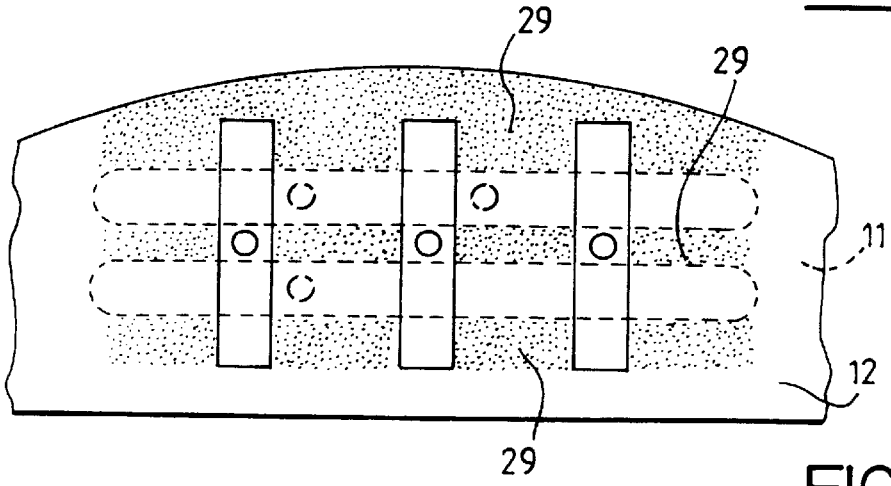

FIGS. 8A, 8B, and 8C are plan views showing the regions of the welding of an inner panel and an outer panel of a shadow mask frame according to the invention, which are assembled and fixed one against the other.

Figure 9:
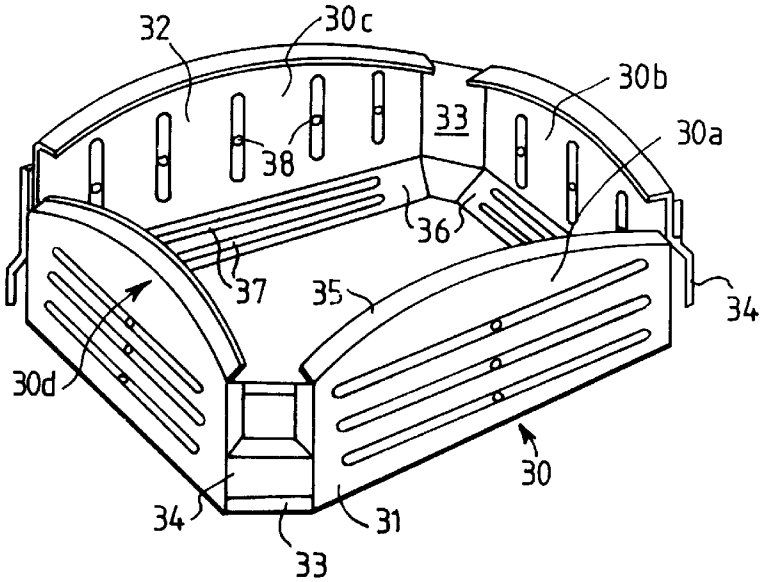

FIG. 9 is a perspective view of a shadow mask frame according to the invention in the assembled state.

Figure 9B:
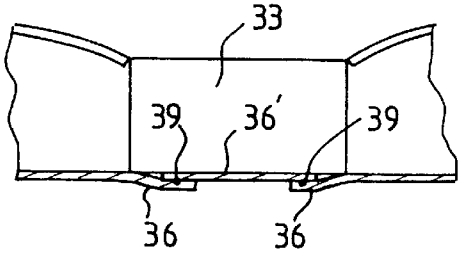
Figure 9A:
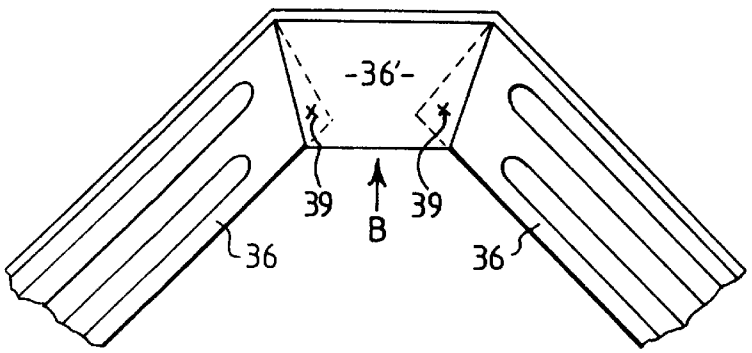

FIG. 9A is a top plan view of a corner region of the frame shown in FIG. 9.

FIG. 9B is an elevational view of the corner region of the frame shown in FIG. 9A.

Figure 10:
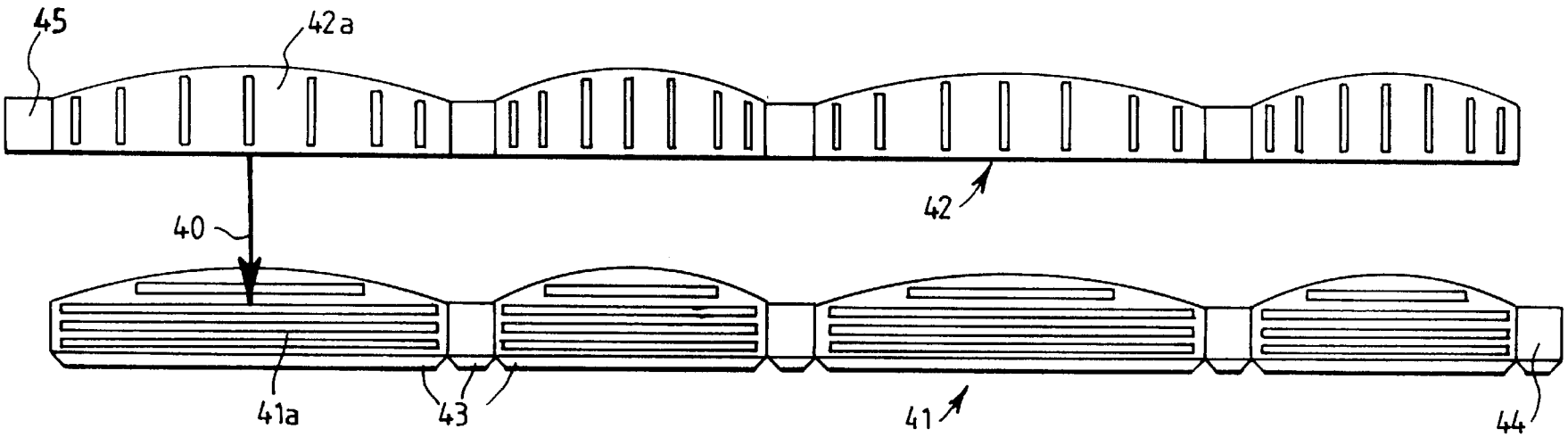

FIG. 10 is a plan view of an outer panel and an inner panel of a shadow mask frame according to the invention, illustrating an alternative manner of manufacturing a frame according to the invention.

Figure 11:
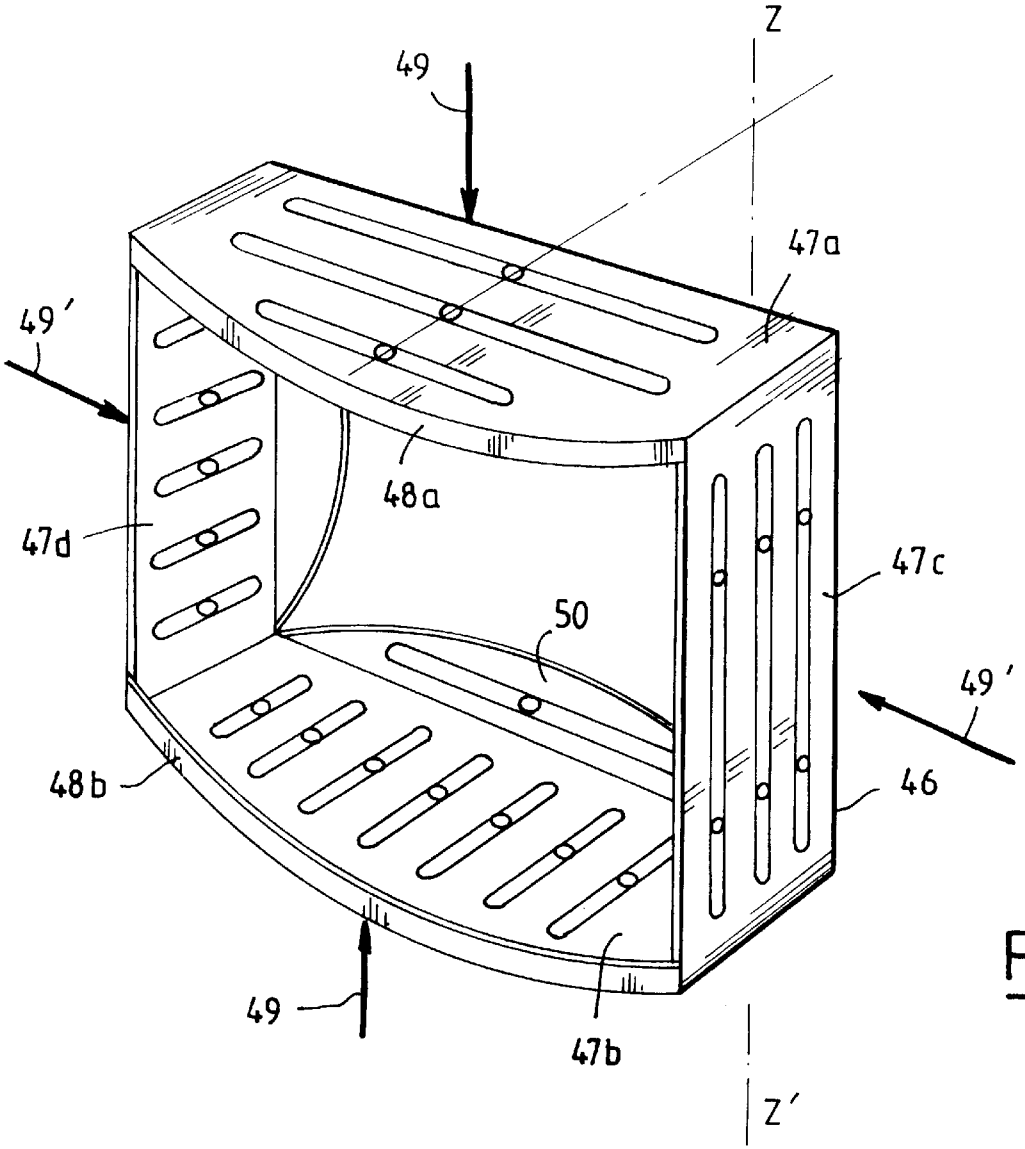

FIG. 11 is a perspective view of a shadow mask frame according to the invention which permits employing the "taut mask" technology.

Figure 12:
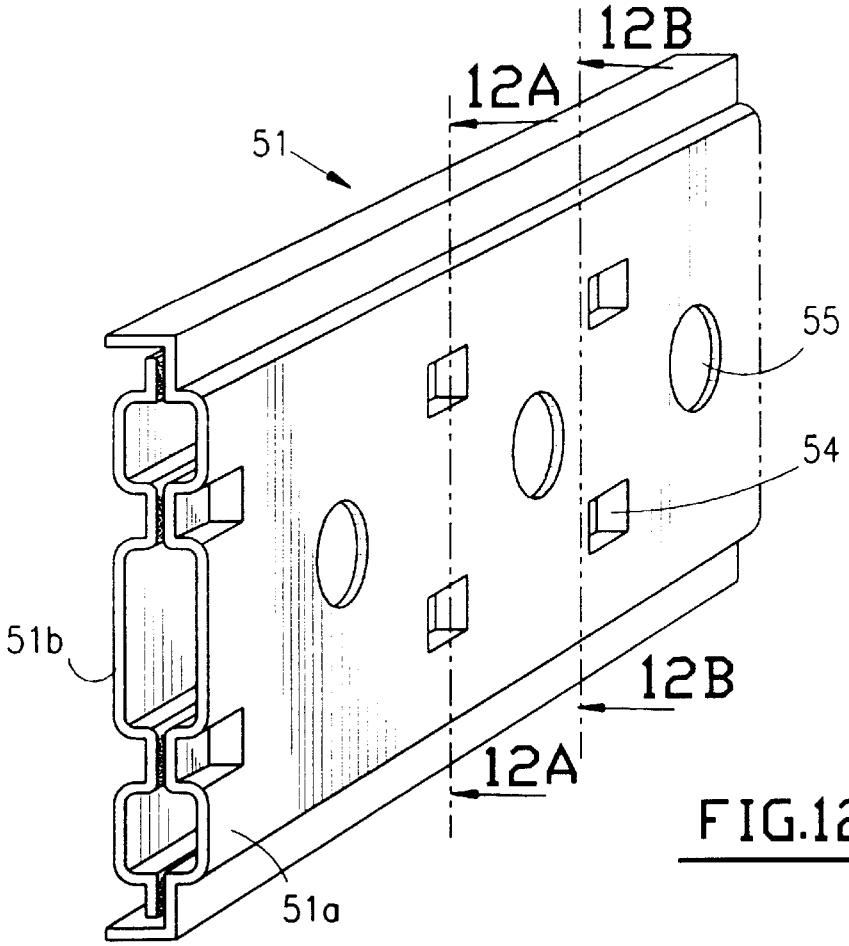

FIG. 12 is a perspective view of a part of a side of a shadow mask frame according to an alternative embodiment of the invention.

Figure 12A:
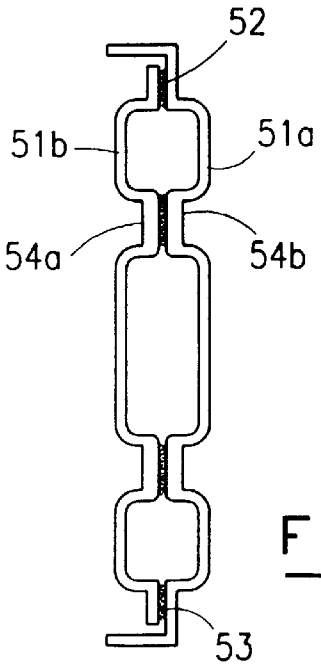

FIG. 12A is a sectional view taken along line A—A of FIG. 12.

Figure 12B:
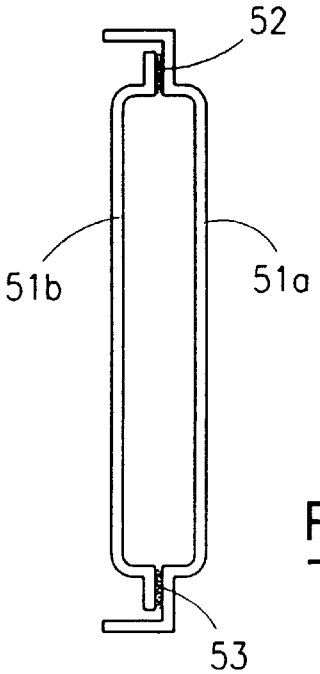

FIG. 12B is a sectional view taken along line B—B of FIG. 12.

Figure 13:
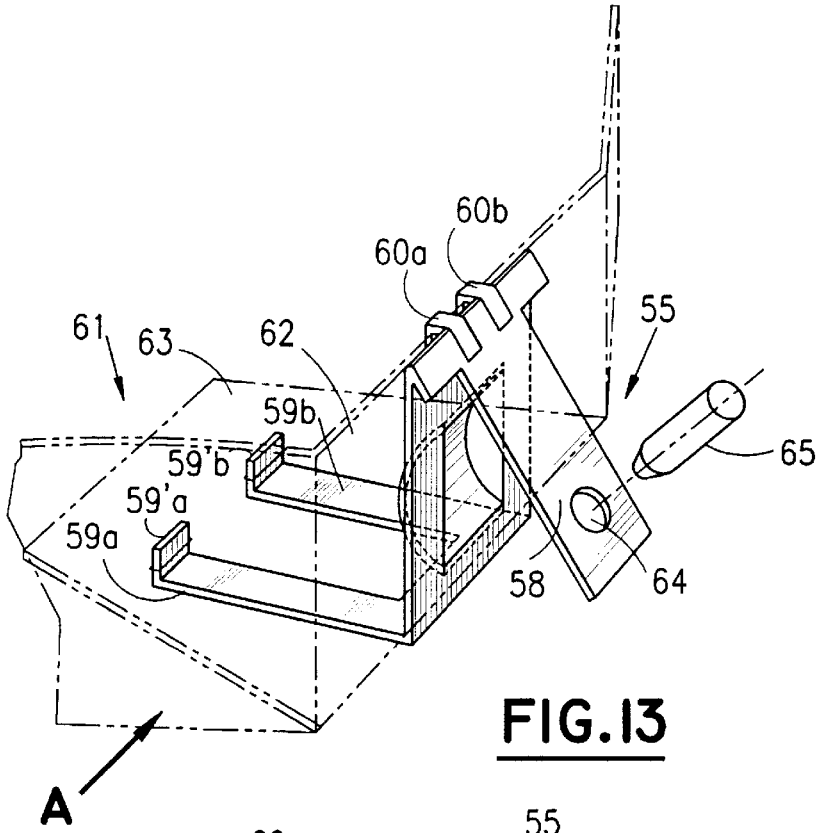
Figure 13A:
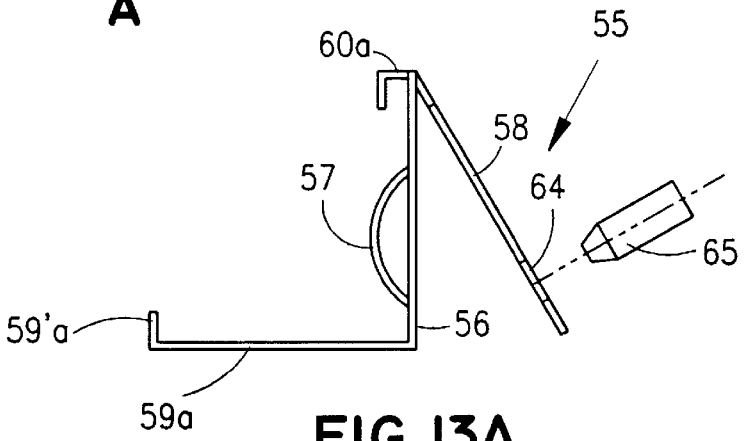
Figure 14:
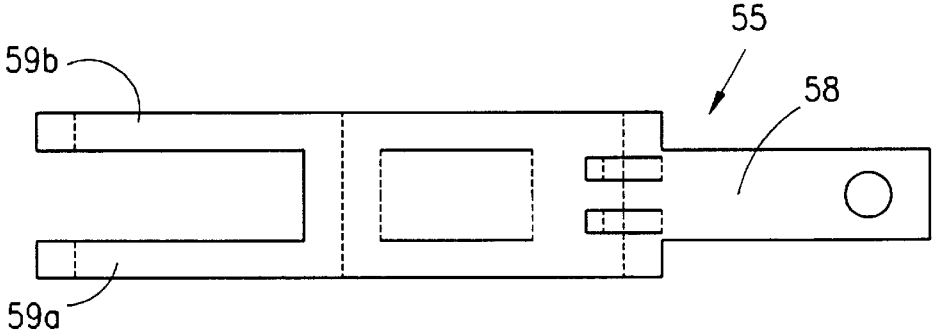

FIGS. 13, 13A and 14 are a suspension element fixed by clipping in a corner portion of a frame.

Figure 1:
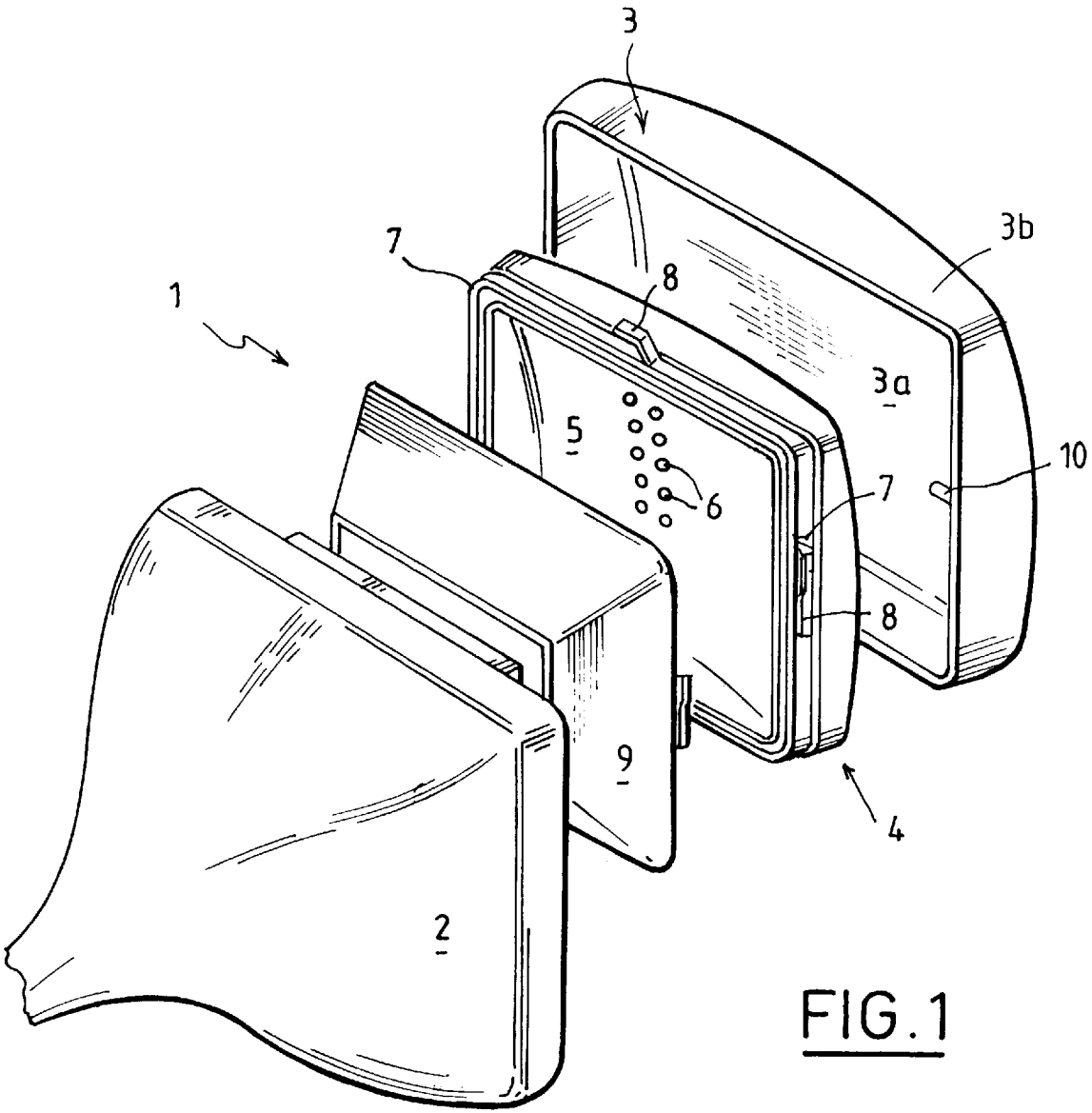
FIG. 1 is an exploded perspective view of a cathode ray tube having a shadow mask.

Shown in FIG. 1 are the various parts making up a cathode ray tube having a shadow mask employed as a colour television tube.

The cathode ray tube, designated by the general reference numeral 1, comprises a glass case consisting of a funnel 2 and a slab 3 and two metal parts 4 and 9 which are to be fixed inside the glass case of the tube.

The part 4 is a pre-assembled unit comprising the shadow mask 5 formed by a metal sheet traversed by openings 6, the frame 7 of the shadow mask and devices 8 for suspending the unit 4 inside the slab 3 of the glass case.

The part 9 is a metal wall shaped in such manner as to constitute an internal magnetic shielding which is engaged in the funnel 2 of the glass case and is most often fixed to the frame.

The funnel 2 of the glass case has a rectangular base with rounded corners and a curved wall having a shape close to that of a cone whose section decreases in the direction toward the rear end of the cathode tube 1 in the region of which there are fixed on the funnel 2 the electron guns and the deflecting coils of the cathode ray tube.

The slab 3 has a slightly curved wall 3*a* constituting the screen of the cathode ray tube and a flange 3*b* whose rectangular base with rounded corners may be perfectly superimposed on the base of the funnel 2. Fixed on the inner surface of the flange 3*b* of the slab 3 are inwardly extending pins, such as the pin 10, for hooking the unit 4 comprising the shadow mask 5 and the frame 7, by means of suspension devices 8 connected to the edge portions of the frame 7. The cathode ray tube 1 shown in FIG. 1 is of the type comprising fixing pins 10 fixed in the median part of the flanges of the slab adapted to cooperate with the suspension devices 8 fixed in a median position on the sides of the frame 7 of the shadow mask 5.

In FIG. 1, the component parts of the cathode ray tube 1 have been shown before their assembly for constituting the cathode ray tube.

In order to manufacture and assemble the cathode ray tube, the component parts 2 and 3 of the glass case, the unit 4 and the magnetic shielding 9 are produced separately. These parts are then assembled in the manner described hereinafter.

The shadow mask 5 is produced from a thin strip in which opening 6 are formed by chemical machining. The perforated sheet is then put into shape by a hot or cold press operation to constitute a mask 5 including a peripheral assembling flange having a substantially rectangular shape with rounded corners.

The frame 7 is fixed by welding to the assembling flange of the shadow mask 5. The fixing devices 8 are then welded to the edge portions of the frame. The unit 4 thus produced is fixed inside the slab 3 after various heat treatments.

The magnetic shielding 9 is then connected to the frame 7, for example by clipping together. In some embodiments, it is necessary to fix the shielding to the pins sealed on the inner wall of the slab.

The glass case can then be assembled.

As has been explained hereinbefore in the case of cathode ray tubes having a shadow mask of the prior art, there has never been produced a shadow mask frame which has a very great mechanical stiffness, low weight and low thermal inertia and may also have a limited sensitivity to periodic stresses in certain frequency ranges.

The frame for a shadow mask according to the invention which will be described hereinafter overcomes the drawbacks of the devices of the prior art.

Figure 2A:
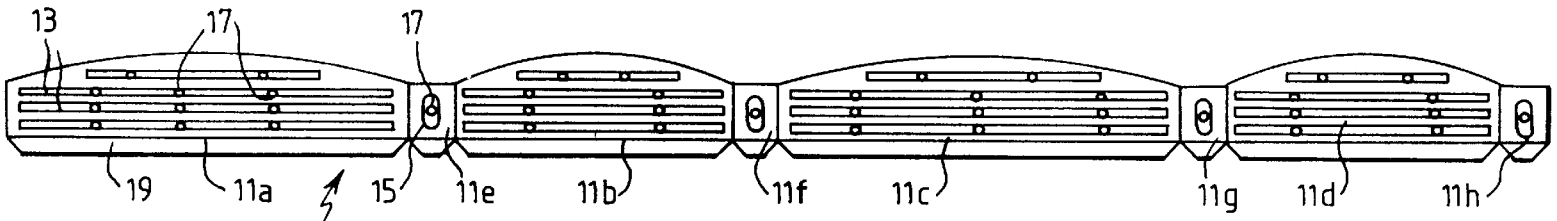
FIGS. 2A and 2B are plan views of metal strips cut-out before forming, for constituting an outer panel and an inner panel respectively of a shadow mask frame according to a first embodiment of the invention.
Figure 2B:
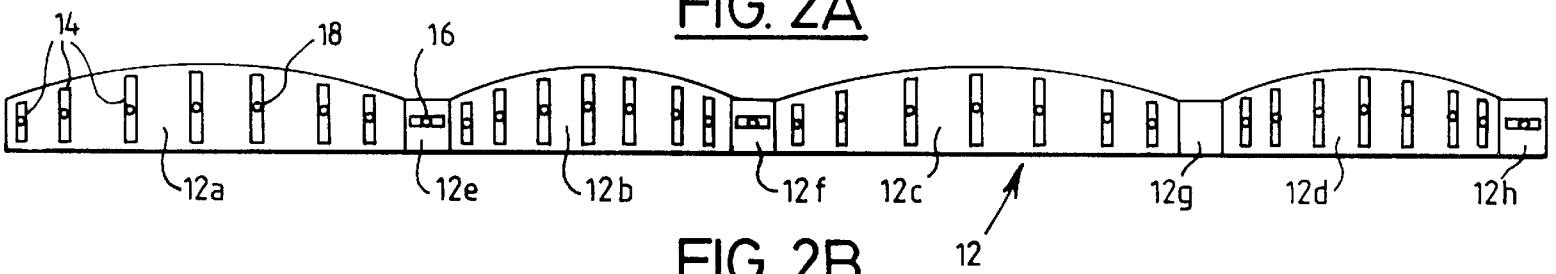

Shown in FIGS. 2A and 2B are respectively an outer panel 11 and an inner panel 12 of a shadow mask frame according to the invention.

The panels 11 and 12 are produced from a thin sheet strip or band composed of a metallic material such as steel, an iron-nickel alloy or some other alloy.

The strip of thin sheet metal is cut out or blanked out along an outer contour which defines four regions 11*a*, 11*b*, 11*c*, 11*d* or 12*a*, 12*b*, 12*c*, 12*d* along the length of the strip which will constitute the outer panel and the inner panel respectively of each of the sides of the shadow mask frame when the strips 11 and 12 are assembled in the form of a frame whose flat sides are disposed along the lateral faces of a rectangular parallelepiped.

The regions 11*a* and 11*c* on one hand and 12*a* and 12*c* on the other of the strips 11 and 12 respectively have an identical shape and are adapted to constitute the panels of a large side of the frame.

The regions 11*b* and 11*d* on one hand and 12*b* and 12*d* on the other of the strips 11 and 12 respectively have an identical shape and are adapted to constitute the panel of the small sides of the frame.

Provided between two successive regions adapted to constitute panels of the sides of the frame and at one of the ends of the strip 11 or 12, are corner or connecting regions 11*e*, 11*f*, 11*g*, and 11*h* for the strip 11 and 12*e*, 12*f*, 12*g*, 12*h* for the strip 12.

In each of the regions adapted to constitute an inner panel or an outer panel of one of the sides of the frame, the metal strip is put into shape, for example by a press operation or by rolling wheels, so as to possess reinforcing ribs which are parallel to one another.

The successive regions of the strip 11 adapted to constitute the outer panels of the frame comprise ribs 13 parallel to the longitudinal edges of the strip.

The regions of the strip 12 adapted to constitute the inner panels of the sides of the frame comprise ribs 14 perpendicular to the longitudinal edges of the strip.

It would also be possible to provide reinforcing ribs parallel to the longitudinal edges of the strip in the regions adapted to constitute a panel of a large or of a small side of the frame and reinforcing ribs perpendicular to the longitudinal edges of the strip in the regions adapted to constitute a panel of the other sides of the frame. Thus, the same strip may comprise in successive regions, ribs extending in a longitudinal direction and ribs perpendicular to this longitudinal direction.

Further, the corner and connecting regions may also comprise ribs 15 (in the case of the strip 11) or 16 (in the case of the strip 12) which are perpendicular to the ribs 13 or 14 of the regions constituting the panels of the sides of the frame.

The sheets 11 or 12 are provided, in the region of each of the ribs 13, 15, 14, 16, with openings 17 or 18 which extend throughout the thickness of the strip so as to avoid trapping gases between the inner and outer panels of the sides of the frame, when the panels are brought together and welded, as will be described hereinafter.

Further, at least one of the two strips (the outer strip 11 in the case of the embodiment shown in FIGS. 2A and 2B) comprises along one of its edges tabs 19 in each of the successive regions constituting a panel of one wall of the frame and in the corner and connecting regions.

Figure 7A:
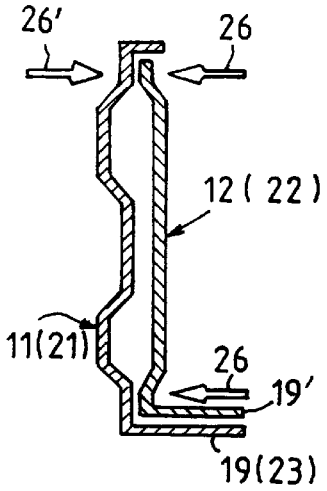
Figure 7B:
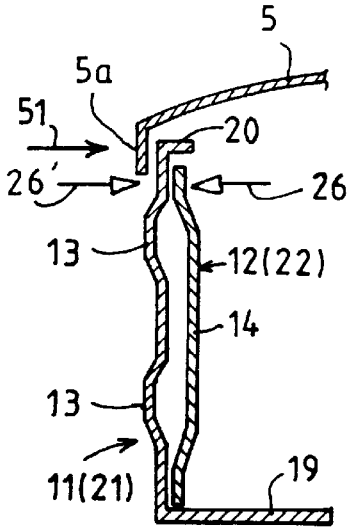

As can be seen in FIG. 7B, when the strip is folded to constitute a frame, the tabs 19 are folded inwardly at 90° with respect to the plane of the strip 11.

It can also be seen in FIG. 7B that a portion 20 of the upper edge of the strip 11 which has a width less than the lower tabs 19, is also inwardly folded at 90°, which contributes to the stiffening of the frame. The shadow mask 5 is mounted and welded along the upper edge portion or flange 20 of the frame.

In FIG. 7B, the shadow mask 5 is in the assembled position. The flange 5*a* of the mask 5 is placed against the upper part of the outer panel of the frame, along the inwardly folded portion 20 of the frame. The mask is welded from outside the frame, as shown by the arrow 51.

Figure 7C:
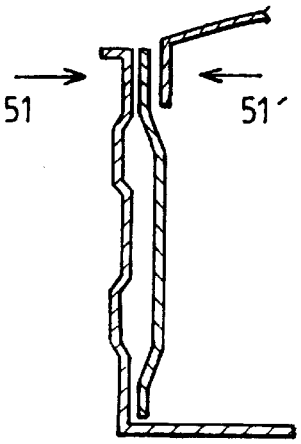

Shown in FIG. 7C is an alternative embodiment of the frame and an alternative manner of fixing the shadow mask. The edge portion 20 of the outer panel of the frame is outwardly folded relative to the frame and the flange 5*a* of the mask 5 is placed against the inner panel of the frame alongside the edge portion 20. The welding may be effected from the outside (arrow 51) or from the inside of the frame (arrow 51'). In an alternative embodiment, the stiffening edge portion 20 could be produced by folding the upper edge portion of the inner panel outwardly over the outer panel, the flange 5*a* of the mask 5 being welded to the inner panel.

Figure 7D:
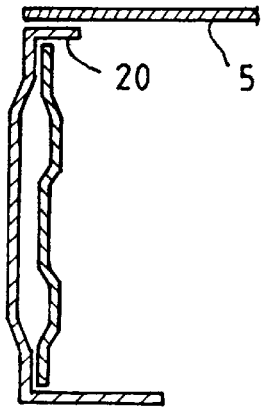

Shown in FIG. 7D is the case of a taut mask frame. In this case, the edge portion 20 and the mask 5 have the shape of portions of a cylinder of circular section. The mask 5 is placed against the edge portion 20 and fixed to the latter by welding. There will be described in more detail hereinafter the mounting of a mask on a frame according to the invention in the case of the "taut mask" technique, with reference to FIG. 11.

As can be seen in FIG. 7A, in certain cases, the interior panel of the frame may also include a flange 19' folded inwardly at 90° and superimposed on the tab 19 of the outer panel.

After the strips 11 and 12 have been blanked out, formed and pierced, the frame is assembled and put into shape.

Figure 4:
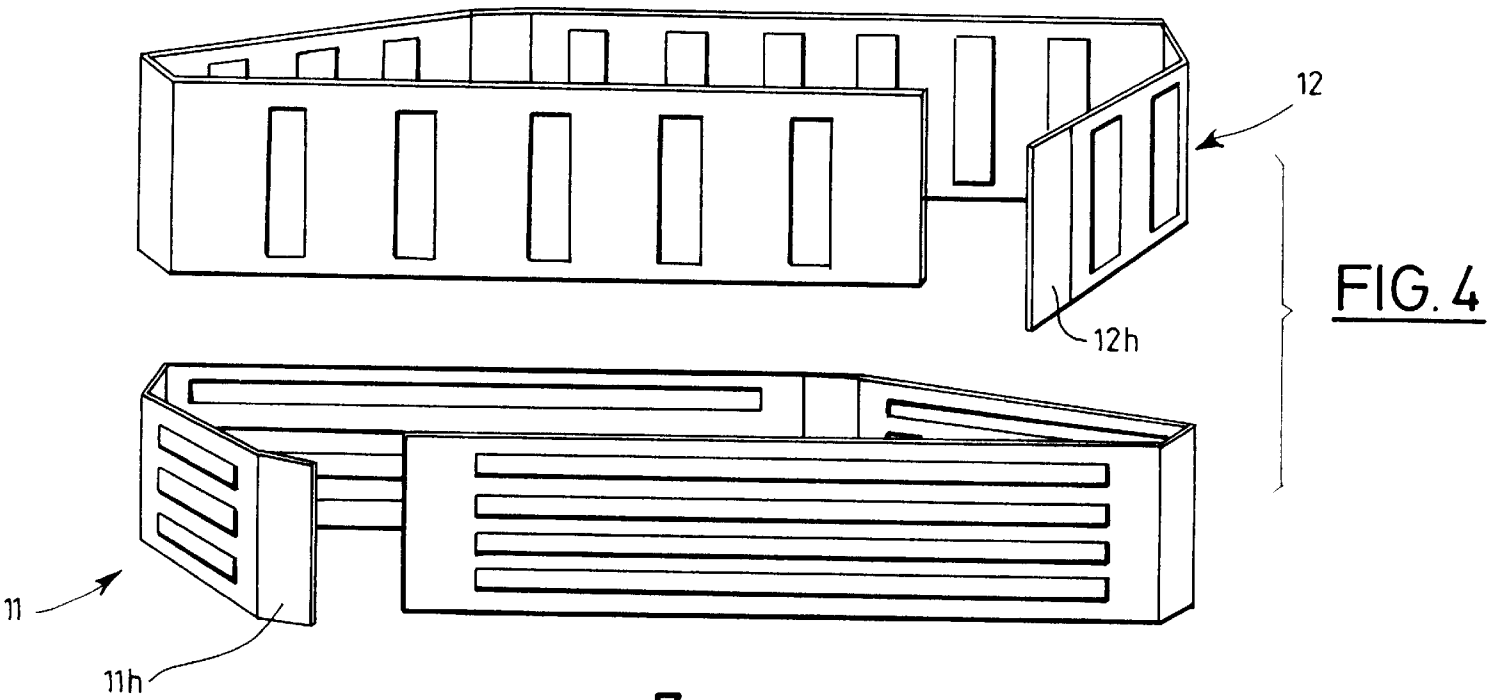
FIG. 4 is an exploded perspective view showing the shaping by folding and the assembly of two metal strips such as those shown in FIGS. 2A and 2B when producing a shadow mask frame according to the first embodiment of the invention.

In the first example of the manner of proceding illustrated in FIGS. 4 and 5, the outer and inner panels of the frame are assembled by welding after the strips 11 and 12 constituting these panels have been folded.

According to an alternative embodiment which will be explained with reference to FIG. 10, the outer and inner panels of the frame may be assembled by welding in superimposed positions before the folding of the panels.

In the case of the first example of the manner of proceeding, an edge portion of the strip 11 adapted to constitute the outer panel located opposite the tabs 19 is folded to constitute a stiffening flange 20 along which the shadow mask is fixed. In some cases, it is possible to also fold the corresponding edge portion of the strip 12 constituting the inner panel, the stiffening flange along which the shadow mask is fixed being then formed by the superimposed flanges of the outer and inner panels.

The tabs 19 of the strip 11 are then folded inwardly as shown in FIGS. 7A and 7B.

Corresponding tabs 19' may be provided on the strip constituting the inner panel 12, these tabs 19' also being inwardly folded at 90°.

The strip 11 constituting the outer panel is folded, as shown in FIG. 4, along the fold lines perpendicular to the longitudinal edges of the strip defining the corner regions 11*e*, 11*f*, 11*g* and the connecting region 11*h*. The strip 11 is placed, after folding, in a jig whereby it is possible to maintain the regions of the strip situated between two corner regions along the lateral faces of a rectangular parallelepiped, as shown in FIG. 5. The outer strip 11 is then maintained in the shape given by the jig, by welding together the tabs 19 constituting one of the folded edge portions of the strip, then the strip 12, after folding, is inserted, as shown in FIGS. 4 and 5, inside this strip 11 constituting the folded and pre-assembled outer panel in accordance with the required shape.

The folded strip 12 is inserted inside the folded and pre-assembled strip 11 in a disposition such as shown in FIG. 5, i.e. with the region 11*d* of the strip 11 in facing relation to the region 12*d* of the strip 12. In this way, the connecting regions 11*h* and 12*h* of the strips 11 and 12 respectively are situated in the corners of the frame at the ends of a diagonal.

After having placed the folded strips 11 and 12 in their position shown in FIG. 5, the superimposed strips are welded, in particular for fixing the connecting regions 11*h* and 12*h* against a facing corner region, as shown by the arrows 24.

The welding may be an electric welding or a welding by means of a laser or plasma. Brazing may also be employed as long as the latter is compatible with the requirements of behavior under a vacuum and of the electronic performance expected from the cathode ray tube.

The embodiment of the frame described with reference to FIGS. 4 and 5 employs two strips 11 and 12 such as those shown in FIGS. 2A and 2B.

It is also possible, in a second embodiment, to produce a frame by using four blanked-out and formed strips, two of these strips constituting an outer panel of the frame and the other two strips constituting the inner panel.

Figure 3A:
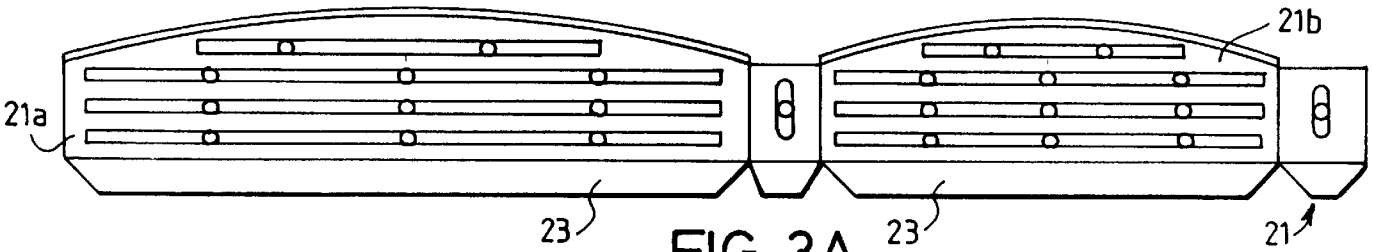
FIG. 3A and 3B are plan views of metal strips which have been cut or blanked out and formed so as to constitute an outer panel and an inner panel respectively of a shadow mask frame according to a second embodiment of the invention.
Figure 3B:
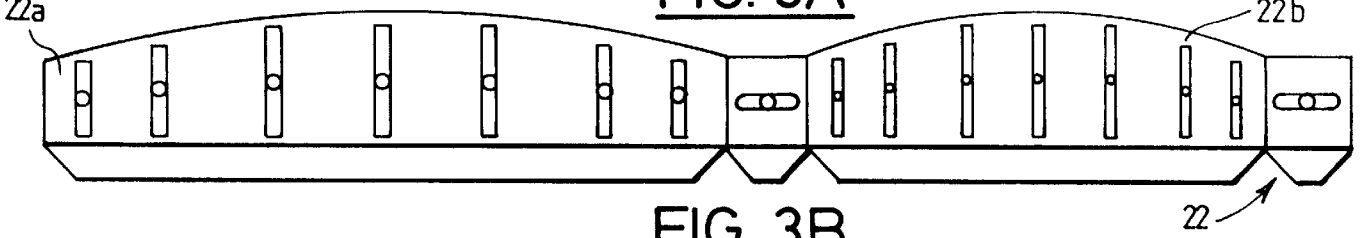

FIGS. 3A and 3B repectively represent a strip 21 constituting a part of an outer panel of a shadow mask frame according to the invention and a blanked-out strip 22 constituting a part of an inner panel of a shadow mask frame according to the second embodiment of the invention.

To produce the frame, there are employed two strips such as the strip 21 and two strips such as the strip 22 which are assembled after folding, as shown in FIG. 6.

The strip 21 comprises two successive regions 21*a* and 21*b* adapted to constitute the outer panel of a large side and a small side respectively of the shadow mask frame.

Likewise, the strip 22 comprises two successive regions 22*a* and 22*b* adapted to constitute the inner panels of a large side and a small side of the frame for the shadow mask. In the same way as the strips 11 and 12 shown in FIGS. 2A and 2B, the strips 21 and 22 comprise corner regions between the regions adapted to constitute the panels of the sides of the frame and a connecting region at one of their ends. It is unnecessary to describe in detail the strips 21 and 22 which are produced in the same way as the strips 11 and 12 and correspond to one half of these strips in the longitudinal direction.

To produce a shadow mask frame as shown in FIG. 6 there are used two strips 21 and 21' adapted to constitute the outer panels of the frame and two strips 22 and 22' adapted to constitute the inner panels.

The outer strips 21 and 21' are folded and disposed in a jig so that the regions of the strips such as 21*a* and 21*b* are disposed along the lateral faces of a rectangular parallelepiped. A pre-assembly is then made of the strips 21 and 21' along the defined paralelepipedic contour, by welding together the tabs or tongue portions 23 provided along a longitudinal edge of the strip 21 and folded inwardly at 90°.

The strips 22 and 22' are folded and inserted inside the frame formed by the strips 21 and 21' which were folded and pre-assembled along a parallelepipedic contour and maintained in the jig.

After folding, the strips 22 and 22' are inserted inside the outer frame constituted by the strips 21 and 21' so that their end connecting regions 22*h* and 22'*h* are positioned in facing relation to two corner regions of the strips 21 and 21' respectively and aligned on a diagonal of the contour defined by the pre-assembled strips 21 and 21' which is different from the diagonal on which the connecting regions 21*h* and 21'*h* of the strips 21 and 21' respectively are aligned.

There is then effected the welding of the strips 21, 21', 22 and 22' brought one against the other in the disposition shown in FIG. 6. In particular, the welding of the connecting regions of the strips is effected along the four corners of the frame, as shown by the arrows 25.

With reference to FIGS. 7A and 7B which are simplified sectional views of the strips respectively constituting the outer panel and the inner panel of the frame, during the welding together of these strips it can be seen that, in the assembled position, the ribs 13 of the outer strip 11 (or 21) face outwardly and the ribs 14 of the inner strip 12 (or 22) face inwardly, so that the planar regions of connection of the outer and inner strips are brought one against the other in their welding position. The welding is effected in these planar regions brought one against the other from the interior or the exterior of the frame, as shown by the arrows 26 and 26'.

The outer and inner strips do not necessarily have the same width and the same thickness, since these dimensions can be adapted to the desired characteristics of the shadow mask frame.

However, the inner panel must overlap or line the largest possible area of the outer panel between its upper edge portion for fixing the shadow mask and its edge portion which is cut out in the form of a tongue portion and folded inwardly.

The inner panel may or may not include an inwardly folded flange 19' superimposed on the flange 19 (or 23) of the outer panel.

FIGS. 8A, 8B, and 8C show an inner panel 12 which is brought against and welded to an outer panel 11, these welded panels constituting a side of a frame for a shadow mask according to the invention.

The embodiments shown in FIGS. 8A, 8B, and 8C differ by the type of welding effected for interconnecting the two panels disposed in superimposed relation.

The panels 11 and 12 comprise stiffening ribs respectively 13 and 14 which extend in perpendicular directions. The panels 11 and 12 have openings 17 and 18 in the region of each one of the ribs 13 and 14 so that the space between one rib of one panel projecting inwardly or outwardly and the surface of the other panel is put in communication with the exterior. In this way it is ensured that no gases are trapped within the walls of the frame, such occluded gases being liable to affect the operation of the cathode ray tube.

In the case of the embodiment shown in FIG. 8A, the panels 11 and 12 were welded by spot welds 27.

The spot welds 27 are in alignment alongside the two longitudinal edges of the panels 11 and 12 and disposed between the ribs 13 and 14.

In the embodiment of the assembly of the panels 11 and 12 shown in FIG. 8B, the two panels are interconnected by seam welding lines 28. There are in particular effected two seam welding lines 28 alongside the longitudinal edges of the panels 11 and 12, seam welding lines surrounding the reinforcing ribs 13 and 14 and generally closed seam welding lines between the reinforcing ribs 13 and 14.

In the case of the embodiment shown in FIG. 8C, the panels 11 and 12 are interconnected by distributing a brazing paste in certain regions 29 situated between the panels 11 and 12 and bringing the pre-assembled frame to a brazing temperature inside a furnace. The two panels 11 and 12 are in this way brazed together in the regions 29.

Preferably, the regions 29 are disposed alongside the longitudinal edges of the panels 11 and 12 and between the reinforcing ribs 13 and 14.

It has been found that the manner of proceeding illustrated in FIG. 8B in which the panels 11 and 12 are interconnected by seam welding lines is the preferred manner ensuring the best interconnection of the panels 11 and 12 which are brought one against the other.

A shadow mask frame 30 is shown in FIG. 9 in its assembled and welded state.

The frame 30 shown in FIG. 9 comprises four flat-shaped sides 30*a*, 30*b*, 30*c* and 30*d* disposed along four lateral faces of a rectangular parallelepiped. Each of the flat sides of the frame 30 is formed by an outer panel 31 and an inner panel 32 which had been welded one against the other.

The outer panels and the inner panels of the four sides of the frame may each be produced from one or a plurality of metal strips. The inner panels and the outer panels are reinforced by ribs which extend in directions perpendicular to one another.

Between two successive flat sides, the frame comprises a planar corner region 33 on which there may be fixed a suspension device 34 for suspending the frame inside the glass case of the cathode ray tube.

The corner regions 33 of the frame may include through openings permitting the fixing of the suspension device 34 by a clipping arrangement. In this way it is possible to achieve an effective fixing of the suspension devices without resorting to welding operations. One of the flanges of the frame, which will be termed the upper flange 35, owing to its disposition in FIG. 9, is used for increasing the stiffness of the structure. The upper flange 35 of the frame 30 is produced by inwardly or outwardly folding one of the longitudinal edge portions of one of the panels 31 and 32, preferably the longitudinal edge portion of the outer panel 31, or possibly by folding confronting longitudinal edge portions of the outer panel 31 and inner panel 32. As explained hereinbefore, the shadow mask is fixed to the frame along the upper flange of the frame 30.

The edge portion of the outer panel remote from the edge 35, termed the lower edge portion, is also folded inwardly so as to constitute tongue portions 36 employed in particular for achieving the pre-assembly of the frame 30. It is also possible to provide foldable tongue portions in the region of each of the sides of the frame, as concerns both the outer panel 31 and the inner panel 32. In this case, the folded lower edge portion of the frame 30 is formed by superimposed tongue portions, which are welded together, of the outer panel 31 and the inner panel 32.

The tongue portions 36 folded inwardly of the frame may include reinforcing ribs 37. The panels may include through openings 38 in the region of each of the reinforcing ribs 37.

In this case, the tongue portions 36, reinforced by the ribs, folded inwardly and welded together, make up a highly rigid unit on which it is possible to fix the magnetic shielding of the cathode ray tube, for example by a clipping arrangement.

As can be seen in FIGS. 9A and 9B, two tongue portions 36 of two successive sides of the frame 30, for example the sides 30*b* and 30*c*, are fixed relative to each other by means of a tongue portion 36' which is cut out or blanked out for example from the lower part of the outer panel in vertical alignment with the corner region 33.

The tongue portion 36' is, in its position folded inwardly at 90°, superimposed on the end portions of the tongue portions 36 and fixed to the latter by spot welds 39. This operation is carried out during the pre-assembly of the frame in a jig which imparts its shape to the frame.

The inner panel 32 can then be placed in position inside the pre-assembled frame maintained in the jig for welding it against the pre-assembled outer panel.

FIG. 10 shows two metal strips 41 and 42 which are blanked out and put into shape to constitute the outer panel and the inner panel respectively of a frame for a shadow mask according to the invention.

The panels 41 and 42 are constructed in substantially the same way as the panels 11 and 12 shown in FIGS. 2A and 2B respectively. In particular, the strips 41 and 42 are so blanked out as to possess regions distributed along the length of the strip adapted to constitute the outer and inner panels of the flat sides of the frame, disposed along the lateral faces of a rectangular parallelepiped. These regions are separated by corner regions. The folding lines of the panels 41 and 42 when producing the frame are the lines perpendicular to the longitudinal direction of the corresponding strip separating the corner regions from the regions adapted to constitute the sides of the frame.

The outer panel 41 comprises an edge, termed lower edge, along which there are blanked out tongue portions 43 which are folded inwardly of the frame at 90° before the frame is folded and put into shape.

The opposite longitudinal edge portion of the panel 41 is folded inwardly or outwardly at 90°.

The cutting out and the inward folding of the edge portions of the panel may be carried out solely on the outer panel or on the outer panel and the inner panel.

The metal strips constituting the panels 41 and 42 are each blanked out at one of their ends to form a connecting region 44 or 45, these connecting regions being brought one against the other and welded after the folding of the strips 41 and 42 when assembling the frame.

The assembling and the welding of the frame formed by the metal strips 41 and 42 shown in FIG. 10 are effected in accordance with the alternative version of the first embodiment described hereinbefore.

The panels 41 and 42 produced from metal strips are manufactured in the same way as in the case of the first embodiment. In particular, there are produced in each of the regions such as 41*a* and 42*a* of the strips 41 and 42 adapted to constitute the outer and inner panels of a side of the frame, reinforcing ribs, for example by a press operation or by rolling wheels.

In the case of the first embodiment, the folding of the strips and their assembly by welding were carried out in succession.

In the case of the alternative manner of proceeding, the welding of the superimposed strips before their folding, then the folding of the double strip obtained and finally the welding of the connecting regions, are carried out in a first stage.

Preferably, the welding together of the strips in the superimposed position is effected by brazing.

To effect the brazing, a brazing paste is spread over different regions of one of the strips, for example the strip 41 adapted to constitute the outer panel.

The brazing paste may be distributed in each of the regions adapted to constitute a panel of one of the sides of the frame, as shown in FIG. 8C.

The brazing paste is deposited on the side of this strip 41, opposite the side from which the reinforcing ribs project.

There is superimposed on the strip 41 covered with the brazing paste the strip 42 so that the latter rests on the strip 41 by its face opposite the face from which the ribs project.

When the strip 42 is placed in position on the strip 41, the region 42 is placed on the region 41*a*, as shown by the arrow 40. In this way, the double strip obtained by the superimposition of the strips 41 and 42 comprises the two connecting regions 44 and 45 at its ends.

The connection by brazing of the strips 41 and 42 is achieved by placing the superimposed strips 41 and 42 in a furnace. At the temperature of the furnace, the brazing paste brazes together the two strips 41 and 42 in their superimposed position.

The double strip obtained is then folded along transverse lines separating the corner regions from the regions constituting the panels of the sides of the frame. The pre-assembly of the frame is then effected by welding together the tongue portions 43, cut or blanked out from the lower edge of the strip 41, which were folded inwardly.

The frame is closed by welding the connecting regions 44 and 45 which are placed against each other.

As in the case of the first and second embodiments, the shape of the frame obtained by folding is imposed and maintained by a jig in the shape of a rectangular parallelepiped.

It is however preferred to manufacture the frame in the manner described hereinbefore with reference to FIGS. 4, 5 and 6.

FIG. 11 shows a frame 46 according to the invention comprising two opposite sides 47*a* and 47*b*, one of the longitudinal edges of which is cut out so as to be in the shape of the arc of a circle and folded inwardly so as to constitute a flange 48*a* or 48*b* of cylindrical shape. The flange 48*a* of the the side 47*a* and the flange 48*b* of the side 47*b* of the frame 46 are contained in a common cylindrical surface having an axis ZZ'. The flanges 48*a* and 48*b* permit fixing by welding on the frame 46, a shadow mask which is therefore disposed and maintained along a cylindrical surface having an axis ZZ'.

The frame 46 permits an easy mounting of a shadow mask of the "taut mask" type.

For this purpose, and as indicated by the arrows 49 and 49', there are exerted on the sides 47*a* and 47*b* a force F producing a bending of the sides 47*a* and 47*b* of the frame inwardly of the frame and on the sides 47*c* and 47*d* a force F' so that the deformation of the flanges 48*a* and 48*b* is in translation.

The shadow mask is welded to the flanges 48*a* and 48*b* while maintaining the force ensuring the bending of the sides 47*a* and 47*b* of the frame.

After the shadow mask has been welded, the bending forces F and F' are released so that the sides 47*a* and 47*b* of the frame return outwardly under the effect of resilience and put the shadow mask under tension.

The frame 46 according to an invention consequently permits very easily and very rapidly carrying out the taut mask technique without the use of a large, heavy and rigid frame.

The frame 46 may also include along the side opposed to the flanges 48*a* and 48*b* a blanked-out flange in the form of tabs 50 reinforced by ribs which are folded inwardly of the frame at 90°. In this case, the magnetic shielding of the cathode ray tube can be fixed to the reinforced tongue portions 50 which are interconnected by welding.

FIG. 12 shows a side 51 of a frame according to an alternative embodiment of the invention.

The sides of the frame, such as the side 51, comprise an outer panel 51*a* and an inner panel 51*b* which are assembled and fixed to each other. In contrast to the embodiments described hereinbefore, the panels are not ribbed and are formed by thin metal strips which are folded and/or press-formed so as to define planar junction portions which come into contact with each other and along which the welding of the panels is effected. As can be seen in FIGS. 12A and 12B, the panels 51*a* and 51*b* may be welded to each other along the upper edge portion 52 and along the lower end portion 53. Further, the panels comprise press-formed regions 54 of a substantially square shape which extend inwardly of the side of the frame and come in contact and are welded in pairs during the assembly of the panels, as can be seen in FIG. 12A (press- formed portions 54*a* and 54*b*).

At least one of the panels 51*a*, as can be seen in FIG. 12, or possibly both panels, are provided with through openings 55 whereby it is possible to avoid trapping gases in the internal space of the wall of the frame.

Further, the outer panel 51*a* is folded in its upper and in its lower part so as to constitute flanges for stiffening and assembling the shadow mask.

The frame constructed in the way and shown in FIGS. 12, 12A and 12B and having panels which are not ribbed, has an overall stiffness in torsion and in flexion which is slightly less than the overall stiffness of a frame made from ribbed metal strips previously described. A modification of the amplitude of certain vibration modes of the structure of the frame is observed.

It will be understood that, in the case of a frame made from non-ribbed panels, these panels may be assembled with each other by welding in accordance with any one of the assembly modes shown in FIGS. 8A, 8B or 8C.

A good stiffness of the structure of the frame may be achieved when the surface of contact of the two panels, for example shown in the region 20, 22 in FIG. 8C, is very smaller than the press-formed surface of the panels in which the panels are separated from each other.

It is also possible to construct the frame from a press-formed metal strip and a non press-formed metal strip which is completely planar. There is still retained in this case sufficient stiffness of the structure of the frame, but the vibration modes of this structure are modified.

Generally, the stiffness of the structure may be optimized in accordance with the number and the width of the ribs formed on the panels. In particular, it is possible to increase the number of ribs as far as the areas permit or to limit the number of ribs and increase the area of these ribs. The ribs may also communicate with one another so as to constitute a single volume.

The shadow mask frame according to the invention whose flat sides are formed by two panels welded together, has, in particular in the case where the panels are ribbed, very great mechanical stiffness, in flexion, in torsion, and in tension and compression, in the case of static forces. Further, owing to its construction from thin metal strips, its weight remains very small for a desired stiffness in the case of the manufacture of cathode ray tubes employing a shadow mask.

Moreover, it was possible to show that the frame according to the invention has a limited sensitivity to outer periodical forces within a frequency range of between 100 and 400 Hz.

The frame according to an invention also has a structure which facilitates the mounting of the shadow mask inside the glass case of the cathode ray tube, for example by using suspension elements which are fixed to the frame by clipping, and also the fixing of the magnetic shielding of the cathode ray tube.

Shown in FIGS. 13, 13A and 14, is a suspension element of a novel type which may be fixed by clipping in a corner portion of a frame according to the invention or of a frame of the prior art.

As can be seen in FIGS. 13 and 13*a*, the suspension element, designated by the general reference numeral 55, comprises an upright 56 on which a spring 57 is formed or mounted and projects from the inner side of the upright 56, a hooking plate 58 connected to the upper edge of the upright and having an inclined disposition with respect to the upright, and two fixing tongue portions 59*a* and 59*b* connected to the lower edge of the upright, substantially perpendicular to the upright and including at their end a lug, respectively 59'*a* and 59'*b*. Further, the upright comprises along its upper edge two hooking tabs 60*a* and 60*b*. The suspension element 55 may be fixed by clipping on a wall 62 of a mask frame 61 constituting a corner region of the mask, as shown in FIG. 13.

In FIG. 13, the mask frame is shown with its vertical sides and its fixing flange for the shadow mask in its upper part.

The hooking tabs 60*a* and 60*b* are engaged on the upper edge of the corner wall 62 of the mask so that the upright 56 comes to bear against the corner wall 62 through the spring 57. The tongue portions 59*a* and 59*b* are slipped under the lower flange 63 of the frame 61 remote from the flange on which the shadow mask is fixed. By exerting a pressure on the upright 56, the spring is compressed and the tongue portions 59*a* and 59*b* are shifted under the lower flange 63 of the mask until the lugs 59'*a* and 59'*b* are engaged in through openings provided in a desired position in the flange 63. The lugs 59'*a* 59'*b* of the tongue portions 59*a* and 59*b* may, in an alternative embodiment, be engaged in the position for fixing the suspension element 55, under the inner edge of the flange 63. The suspension element 55 is fixed on the frame 61 by clipping, the spring 57 being compressed against the corner wall 62 of the frame and exerting a tensile force on the tongue portions 59 and 59*b* whose lugs 59'*a* and 59'*b* are engaged in openings or against an inner edge of the flange 63.

The suspension element, which is moreover hooked on the upper edge of the frame by the tabs 60*a* and 60*b*, is perfectly fixed to the frame. If need be, the fixing of the suspension element may be completed by a laser spot weld or an electric welding.

The hooking plate 58, has a through opening 64 which is engaged on a hooking pin 65 sealed in an inner part of the slab of the cathode ray tube in the vicinity of a corner of the slab.

Advantageously, the suspension element 55, may be produced by cutting out and folding a thin metal strip, as shown in FIG. 14 in which the cutting lines of the metal strip are shown in full lines and the folding lines are shown in dotted lines.

The suspension element 55 may also be made in a plurality of parts which are assembled and welded together.

The suspension element must be made from a steel or alloy having a high yield strength, for example:

- a maraging steel such as a steel having 18% nickel, 9% cobalt and including molybdenum and titanium,
- a hardened steel having 25% nickel, 15% chromium and including titanium and aluminium,
- an iron-nickel alloy hardened by carbides such as an alloy containing 37% nickel, 2% molybdenum, 0.8% chromium and 0.25% carbon, in a highly work-hardened state. This alloy has the advantage of a low coefficient of expansion, of the order of $2.10^{-6}$/°K.,
- a nickel-base superalloy with a structural hardening such as the alloy 718,
- certain stainless martensitic alloys.

All these steels and alloys have been selected owing to the fact that they have a high yield strength and they retain their resilience after the required heat treatments during the manufacture of colour television tubes.

The alloys employed are preferably non-magnetic.

Suspension elements such as the element 55 shown in FIGS. 13 and 13*a* have the advantage of the possibility of fixing them to a shadow mask frame without necessity to obtain a connection by a resistence weld. Consequently, the suspension elements may be easily disassembled so that it is possible, in the case where, in the course of manufacture of the frame, a quality control indicates that the frame is not in conformity, to recover the frame and/or the suspension elements. Moreover, fixing without welding the suspension element to a rigid and light frame avoids deforming the frame when fixing this element.

Further, the suspension element such as described hereinbefore is simple to produce at low cost and may be placed in position and fixed to the mask frame in a simple and rapid manner.

The metal strips employed for producing the panels making up the sides of a shadow mask frame according to the invention may be composed of a low carbon steel such as the steel AK, an iron-base alloy, an iron-nickel alloy such as Invar having a low thermal expansion, an iron-chromium alloy, a nickel-base alloy, an alloy having a structural hardening or a hardening of the martensitic type, these alloys permiting a considerable increase in the stiffness of the structure of the frame, or of a magnetic alloy, a non-magnetic alloy, or an alloy damping vibrations.

The two panels may be composed of the same metallic material selected from the materials listed hereinbefore.

The outer panel and the inner panel could also be composed of different materials, at least one of the materials of the panels being selected from the materials listed hereinbefore.

The use of two different alloys may in particular permit:

a) improving the magnetic performances of the frame by using a magnetic alloy for one of the panels and a low carbon steel for the other panel, for example a panel of steel and a panel of mumetal or a steel panel and an Invar panel.

b) improving the frequency response of the frame by using an alloy damping vibrations in the frequency range 100–400 Hz for one of the panels.

c) taking advantage of the bimetal effect inherent in heterogeneous structure employing different alloys.

Generally, the metal strips employed for producing the panels of the frame according to the invention are thin strips whose thickness is no more 0.1 mm, while the known thin frames of the prior art have a thickness of the order 0.2 mm. Producing the frame according to the invention from two superimposed panels provides a frame stiffness which is ten times greater with a saving in weight of 20% as compared with the thin frames of the prior art.

It will be understood that the frame is constructed in such manner as to permit and facilitate the fixing of the shadow mask. In particular, the position of the reinforcing ribs of the panels of the sides of the frame is such as to permit the positioning and the fixing of the shadow mask without difficulty. This fixing of the shadow mask may be achieved by electric welding of the flanges of the frame, which corresponds to the known method.

Shadow masks of the "taut mask" type may be manufactured by employing a frame whose fixing flanges have a cylindrical symmetry. In this case, the mask may be put under tension by flexing two sides of the frame, as explained hereinbefore.

By using suitably chosen alloys having a high yield strength, a frame for a taut mask may be designed which is of great stiffness and much lighter than the frames for a taut mask of the prior art.

It must be understood that the scope of the invention is not intended to be limited to the described embodiments.

Thus, it is possible to manufacture the frame with the use of two or four portions of metal strips which were previously blanked-out and previously formed, or with the use of a number of strips exceeding four, depending on the manner of assembling and welding the strips and the shape of the section of the frame. It is of course possible to envisage the manufacture of frames whose contour is not rectangular. The blanked-out strip portions may or may not include corner regions or connection regions in addition to the regions having the shape of flat sides of the frame.

The reinforcing ribs of the panels may be arranged and have shapes which are different from those indicated.

The suspension element according to the invention may bave a single tab or a single tongue portion for hooking on the shadow mask frame, or more than two tabs or more than two tongue portions.

What is claimed is:

1. A Shadow Mask Frame of a cathode ray tube, and in particular a colour television tube, said frame having flat sides disposed along lateral faces of a right prismatic surface and having a stiffening edge portion for fixing a shadow mask on said frame which enables placing said shadow mask in position inside a glass case of said cathode ray tube, said case comprising a funnel and a slab comprising a screen, said flat sides of said frame comprising an outer panel and an inner panel which are brought together and fixed to each other, each panel being formed by a portion of a thin metal strip.

2. The shadow mask frame according to claim 1, comprising at least one press-formed portion of at least one of said outer and inner panels for reinforcing said at least one panel.

3. The shadow mask frame according to claim 2, comprising ribs for reinforcing said at least one panel.

4. The shadow mask frame according to claim 3, comprising ribs for reinforcing said outer panel and said inner panel, the ribs of said outer panel extending in a direction perpendicular to the ribs of said inner panel.

5. The shadow mask frame according to to claim 3, wherein at least one panel comprises ribs disposed in two directions perpendicular to each other.

6. the shadow mask frame according to claim 2, comprising at least one opening in said inner panel and said outer panel in the region of each of said press-formed reinforcing portions.

7. The shadow mask frame according to claim 3, comprising at least one opening in said inner panel and said outer panel in the region of each of said ribs.

8. The shadow mask frame according to claim 1, wherein said outer panel and said inner panel are fixed to each other by spot welds.

9. The shadow mask frame according to to claim 1, wherein said outer panel and said inner panel are fixed to each other by continuous seam welds.

10. the shadow mask frame according to claim 1, wherein said outer panel and said inner panel are interconnected by a brazing product distributed in regions between said panels.

11. The shadow mask frame according to claim 1, wherein said outer panel and said inner panel are composed of the same material.

12. The shadow mask frame according to claim 10, wherein said material is selected from the group comprising the following materials: low carbon steel, iron-base alloy, iron-nickel alloy, iron-chromium alloy, nickel-base alloy, alloy having a structural hardening, alloy having a hardening of the martensitic type, magnetic alloy, non-magnetic alloy, other vibration damping alloys.

13. The shadow mask frame according to claim 1, wherein said outer panel and said inner panel are composed of different materials.

14. The shadow mask frame according to claim 13, wherein at least one of said materials constituting said outer panel and said inner panel is selected from the group comprising the following materials: low carbon steel, iron-base alloy, iron-nickel alloy, iron-chromium alloy, nickel-base alloy, alloy having a structural hardening, alloy having a hardening of the martensitic type, magnetic alloy, non-magnetic alloy, other vibration damping alloys.

15. The shadow mask frame according to claim 1, comprising substantially planar corner regions between successive sides of said frame.

16. the shadow mask frame according to claim 15, comprising a suspension element for suspending said frame in said glass case of said cathode ray tube, said device being fixed by clipping inside at least one opening in each of said corner regions.

17. The shadow mask frame according to claim 1, comprising an edge portion which is remote from said stiffening edge portion along which said shadow mask is fixed and is constituted by a portion of at least one of said outer and inner panels of said sides of said frame which is folded at 90° inwardly of said frame and includes reinforcing ribs for fixing a magnetic shielding of said cathode ray tube by means of a clipping together.

18. The shadow mask frame according to claim 1, comprising two opposite and parallel sides each of which has an edge portion for the mounting of said shadow mask constituted by a portion of at least one panel of the two sides of said frame which is folded inwardly of said frame so that said edge portions for mounting said shadow mask are contained in a common cylindrical surface.

19. The shadow mask frame according to claim 1, wherein said sides of said frame are disposed along lateral faces of a rectangular parallelepiped.

20. Process for manufacturing a shadow mask frame of a cathode ray tube, such as a colour television tube, having flat sides disposed substantially along the lateral faces of a right prismatic surface, said process comprising:

cutting out from at least one thin metal strip at least one first panel and at least one second panel comprising, along the length of said metal strip, at least one region having the shape of a flat side of said frame to be produced so as to obtain for each of said sides of said frame to be produced, said at least one first panel and said at least one second panel which may be superimposed, producing in each of said at least one region of said at least one first panel and said at least one second panel press-formed reinforcing portions by deformation of the corresponding metal strip, assembling said frame by welding said at least one first panel and said at least one second panel in arrangements in which they are placed one against the other.

21. Process according to claim 20, wherein said press-formed portions are ribs.

22. Process according to claim 20, wherein said at least one first panel and said at least one second panel further comprise at least one corner region adjacent to a region having the shape of a flat side of said frame.

23. Process according to claim 20, wherein said at least one first panel and said at least one second panel further comprise at least one connection region adjacent to a region having the shape of a flat side of said frame.

24. Process according to claim 20, comprising effecting a folding and a positioning of said at least one first panel and said at least one second panel against each other in accordance with the shape of said frame to be produced, and welding said at least one first panel and said at least one second panel brought one against the other and maintained in accordance with the shape of said frame to be produced.

25. Process according to claim 20, comprising superimposing said at least one first panel and said at least one second panel so that regions corresponding to the same side of said frame are superimposed, ensuring the interconnection of said at least one first panel and said at least one second panel in the superimposed position thereof, effecting a folding and an assembling of said superimposed and interconnected at least one first panel and said at least one second panel so as to produce said frame.

26. Process according to claim 25, comprising effecting the interconnection of said at least one first panel and said at least one second panel in said superimposed position by spreading a layer of a brazing product on a surface of said at least one first panel, superimposing said at least one second panel on said surface of said at least one first panel on which said brazing product has been deposited , and bringing said superimposed at least one first panel and said at least one second panel to a brazing temperature.

27. Process according to claim 20, for producing a frame whose flat sides are disposed along the lateral faces of a rectangular parallelepiped, said at least one first panel and said at least one second panel comprising along the length thereof four regions having the shape of the four sides of said frame in the shape of a rectangular parallelepiped, three corner regions each interposed between two regions corresponding to two sides of said frame, and a connection region at one of the ends of the respective panel.

28. Process according to claim 20, for producing a frame whose flat sides are disposed along the lateral faces of a rectangular parallelepiped, said process comprising cutting out two first panels and two second panels each comprising a first region corresponding to a first side of said frame, a second region corresponding to a second side of said frame, a corner region between said first region and said second region and a connection region at one of the ends of the respective panel.

29. Suspension element for suspending a shadow mask frame inside a slab of a cathode ray tube, comprising a plate through which extends an opening for the engagement of said suspension element on a pin connected to said slab of said cathode ray tube, means for fixing said suspension element to a wall of said frame, said means for fixing said suspension element to said wall of said frame comprising in combination:

an upright connected to said plate and having at least one tab for hooking on an edge of said wall of said frame, a spring projecting from an inner face of said upright which comes into contact with said wall of said frame, and at least one tongue portion substantially perpendicular to said upright and extending inwardly of said frame and comprising a hooking lug at the inner end thereof for fixing said suspension element on said frame by a clipping together, said hooking lug of said tongue portion being engaged on a retaining element of said frame and said spring being compressed between said upright and said wall of said frame.

30. Suspension element according to claim 29, formed by a thin cut-out and folded metal strip.

31. Suspension element according to claim 29, made from a metallic material having a high yield strength selected from the group comprising the following materials:

maraging steels, steel containing 25% nickel and 15% chromium including titanium and aluminium iron-nickel alloys, nickel-base superalloys, stainless martensitic alloys.

* * * * *